United States Patent [19]

Woog et al.

[11] Patent Number: 5,067,480

[45] Date of Patent: Nov. 26, 1991

[54] STIMULATOR

[75] Inventors: Philippe-Guy E. Woog; Michel A. Moret, both of Geneva, Switzerland

[73] Assignee: Les Produits Associes LPA-Broxo S.A., Geneve, Switzerland

[21] Appl. No.: 320,711

[22] Filed: Mar. 8, 1989

[51] Int. Cl.[5] ..... A61H 1/00; A61H 7/00; A61H 19/00

[52] U.S. Cl. ..... 128/32; 128/36; 128/44; 128/49; 128/67

[58] Field of Search ..... 128/24.1, 32, 36, 44, 128/45, 46, 47, 57, 67, 49, 24.5, 79

[56] References Cited

U.S. PATENT DOCUMENTS

| | | | |
|---|---|---|---|
| 2,547,243 | 4/1951 | Amer | 128/67 |
| 3,968,789 | 7/1976 | Simoncini | 128/49 |
| 4,326,508 | 4/1982 | Stauffer | 128/57 |
| 4,498,463 | 2/1985 | Roming | 128/47 |
| 4,595,850 | 6/1986 | Woog | 310/47 |
| 4,777,940 | 10/1988 | Yamasaki | 128/46 |
| 4,881,526 | 11/1989 | Johnson et al. | 128/24.5 |

FOREIGN PATENT DOCUMENTS

| | | | |
|---|---|---|---|
| 2449128 | 4/1976 | Fed. Rep. of Germany | 128/32 |
| 2933117 | 2/1981 | Fed. Rep. of Germany | 128/32 |
| 221983 | 9/1924 | United Kingdom | 128/45 |

*Primary Examiner*—Edgar S. Burr
*Assistant Examiner*—Moshe I. Cohen
*Attorney, Agent, or Firm*—Kane, Dalsimer, Sullivan, Kurucz, Levy, Eisele and Richard

[57] ABSTRACT

A stimulator for use in marital orgasmic therapy is provided. The stimulator uses a step-down transformer and a water-proof case. The stimulator oscillates at 2000–8000 (preferably 3000–3600) cycles per minute throughout an angle of operation chosen from the range of 10 to 80 (preferably 20 to 60) degrees. An integrated set includes several different detachable attachments and a handle with mechanical oscillating means.

12 Claims, 4 Drawing Sheets

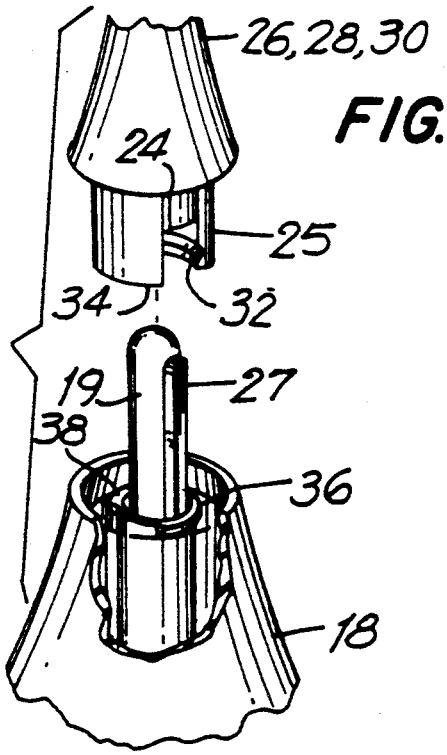
FIG. 3
FIG. 6a
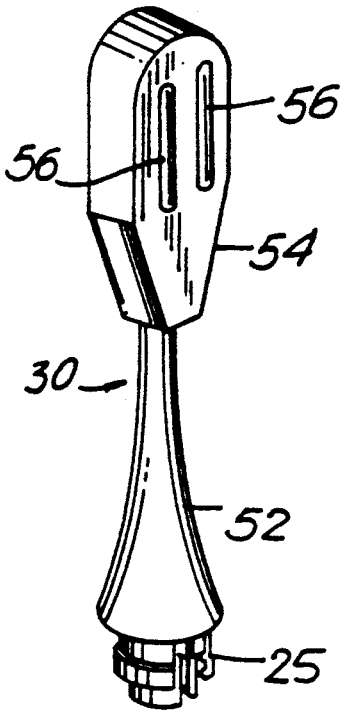
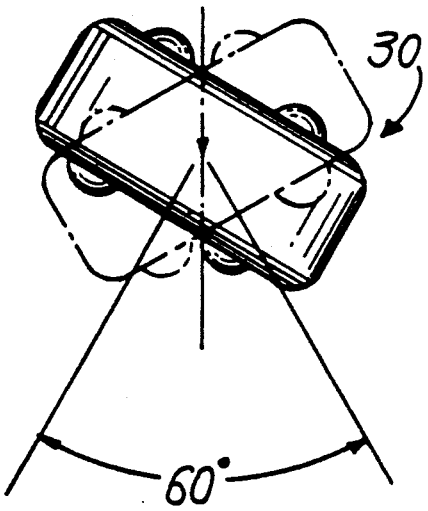
FIG. 6b

FIG. 4a
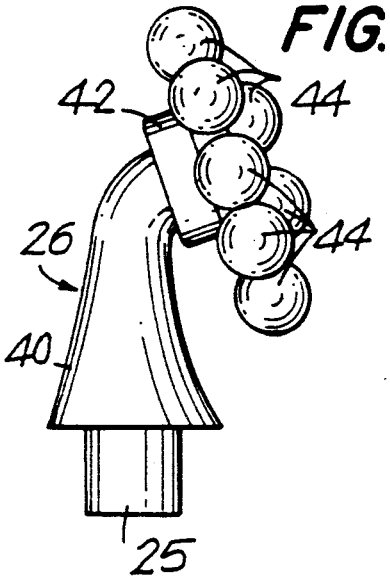
FIG. 4b
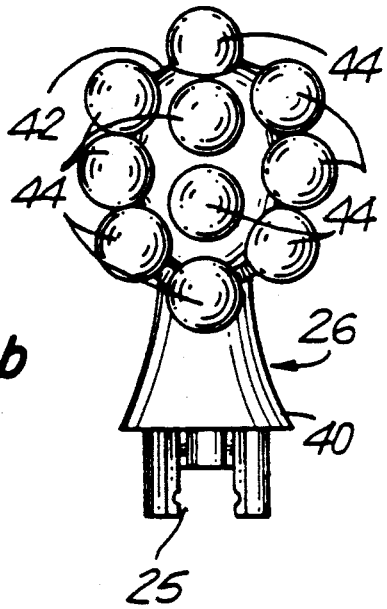
FIG. 4c
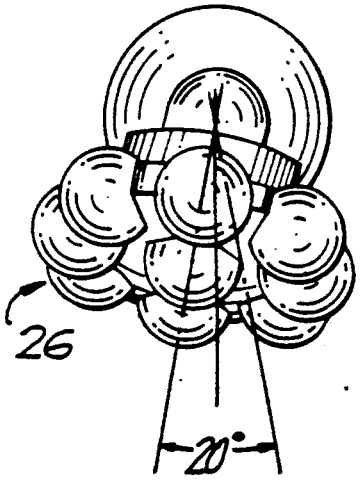
FIG. 4d
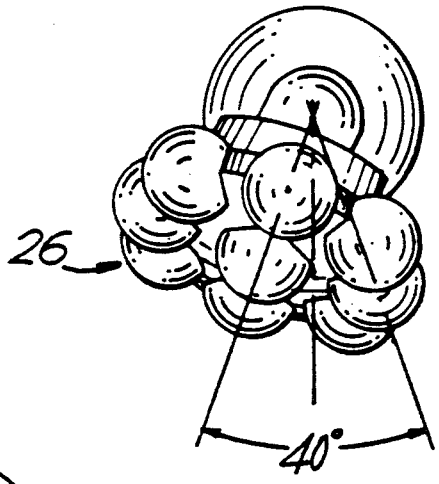
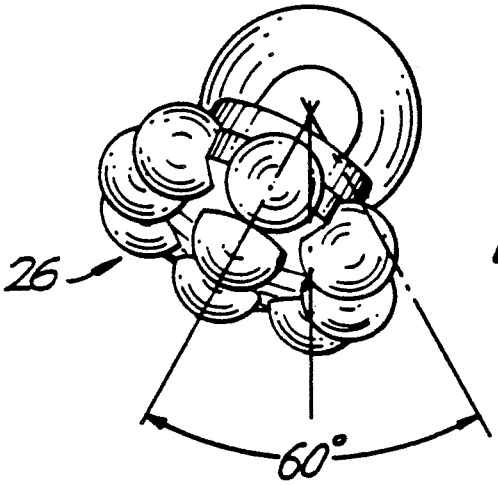
FIG. 4e FIG. 5a
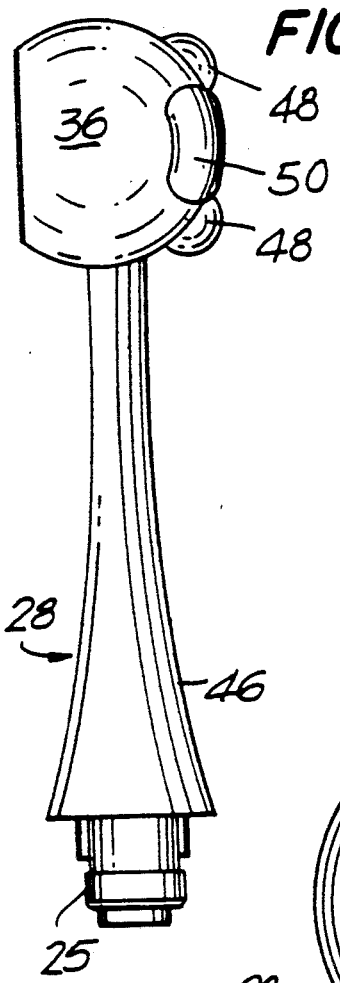
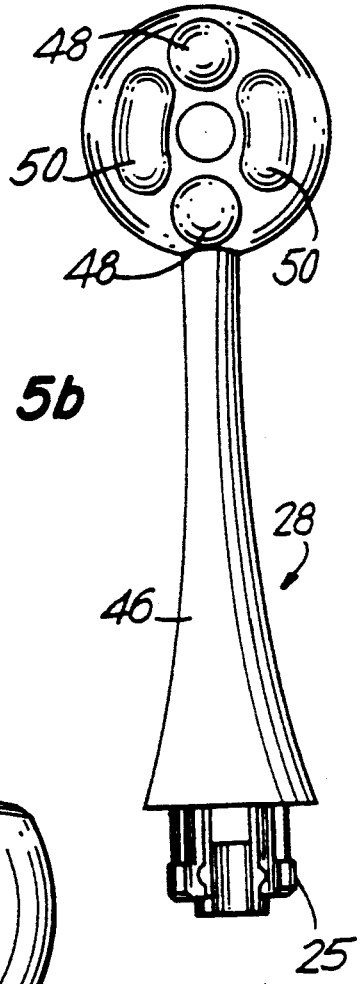
FIG. 5b
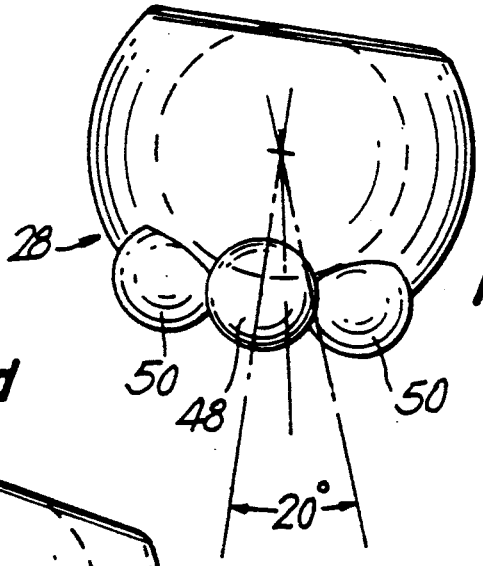
FIG. 5c
FIG. 5d
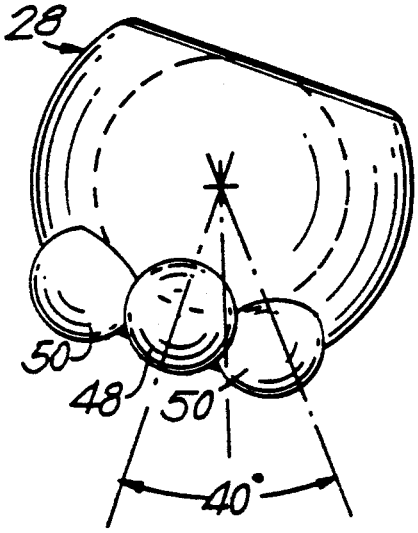
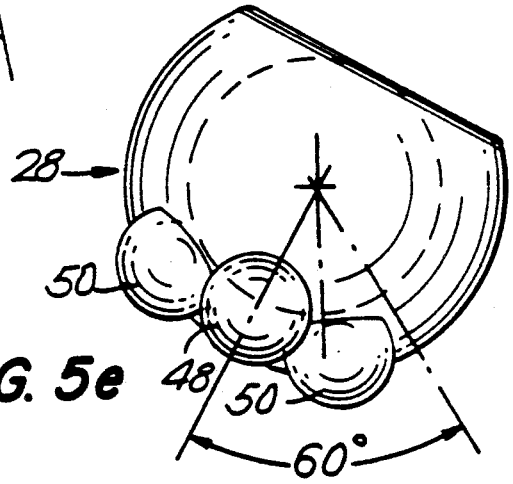
FIG. 5e

STIMULATOR

BACKGROUND OF THE INVENTION

1. Field of the Invention

This invention relates to a stimulator or marital aid for use in marital/sexual therapy.

2. Background of the Prior Art

Within the last several decades, the existence and desirability of the female orgasm has been virtually universally accepted by civilized society. Yet it is equally well-established that a large percentage of women do not orgasm regularly during sexual intercourse. Indeed, a substantial minority of women report that they rarely, if ever, orgasm during sexual intercourse. For a substantial number of married couples, this can lead to tension and frustration which, in turn, leads to marital discord. Assuming that this is not a result of lack of facility on the part of her husband or intractable trauma-based psychological problems on her part, orgasmic therapy can replace or substantially supplement traditional marital therapy for such troubled couples.

Orgasmic therapy for women inevitably involves self-stimulation. While arguments have persisted for years whether internal (vaginal) orgasms were a more mature form of orgasm than external (clitoral) orgasms or merely the result of indirect external pressure, the fact remains that external orgasms are much easier for the woman to self-stimulate than internal orgasms and therefore external pressure is the method of choice in orgasmic therapy.

As sexually dysfunctional women, who are under the psychological pressures which are attendant with therapy, are sometimes reluctant to stimulate themselves manually, a mechanical device such as a vibrator may be required for effective marital therapy. Similarly, a vibrator is preferred over self-stimulation in that a mechanical device can achieve high vibrational rates which can not be manually achieved. Furthermore, in the latter stages of therapy, a vibrator may allow the patient to continue stimulation past the initial orgasm to achieve multiple orgasms. This is in contradistinction to manual self-stimulation, which a woman may be unable or unwilling to continue past the initial orgasm.

After therapy is discontinued, the couple can use the vibrator or marital aid on a maintenance or recreational program.

Similarly, a vibrator can be used in the context of a married couple which is certainly not dysfunctional, yet wherein the wife simply has a greater sexual appetite or is slower to respond and climax than is the husband.

Additionally, it is well-established that the female orgasm relieves cramps, a major source or irritability, during menstruation. However, many wives are reluctant to engage in marital relations with their husband during menstruation. A vibrator can be used in such a context for relief of cramps and irritability associated with menstruation.

Moreover, a vibrator can be used for socially desirable, yet less then therapeutic, purposes. For example, the disabled or elderly can use a vibrator to induce orgasms after the death, desertion or lack of capacity or availability of a spouse. The socially desirable goal of marital fidelity may be achieved by a woman having access to a vibrator while her husband is injured, ill or absent for long periods. Similarly, in view of the prevalence of sexually transmitted diseases today, a vibrator is desirable in that it allows a single woman to experience orgasm and relieve tension more satisfactorily and reliably than by resorting to indiscriminate pre-marital sexual intercourse which frequently leads to undesirable and dangerous consequences.

Indeed, the prevalence of female self-stimulation has been documented by the Kinsey Report of the early 1950's (40%), a Cosmopolitan magazine survey of 1981 (89% with 26% using a vibrator) and a New Woman magazine survey of 1986 (87% with 43% using marital aids, presumably including vibrators).

In the prior art, vibrators are frequently phallic-shaped to simulate the movement of the husband's sexual organ. The prevalence of this kind of vibrator is possibly the result of male misunderstanding of the process of the female orgasm. As previously described, direct clitoral pressure is the method of choice for marital orgasmic therapy.

Similarly, possibly due to male misunderstanding of female sensitivities or the maladaption of devices originally designed as back, shoulder or scalp massagers, many vibrators in the prior art are unnecessarily rough and therefore not suitable for marital orgasmic therapy.

In vibrators of the prior art, agitation is necessarily harsher because the vibrations are designed to cover a wider area, thereby causing a risk of irritation to soft tissue and mucosa traumatization which is unsuitable for marital orgasmic therapy. Indeed, at least one vibrator of the prior art incorporated a "hammering" motion.

Furthermore, the vibrating motion itself may be undesirable. However, the prior art has unquestioningly and unscientifically accepted this form of motion as several million vibrators of the prior art have been sold for the last several decades.

Vibrators of the prior art typically have vibrated or "hammered" through an angle of only 3-5 degrees so that they would slide off the clitoris or desired area easily, therefore forcing the marital therapy patient to go from a mid-point of arousal back to the beginning.

Similarly, vibrators of the prior art are sometimes large, heavy and cumbersome to use.

Furthermore, in vibrators of the prior art, typically only one range of operation is provided. This is not well-suited for applications wherein women with a wide range of sensitivities are to be treated.

Similarly, in vibrators of the prior art, typically only one applicator head is provided. Again, a single applicator head is not well-suited for application to marital orgasmic therapy wherein women with a wide range of sensitivities are to be treated.

Vibrators of the prior art are powered either by wall socket voltage or batteries. The former results in a device which would reach undesirable temperatures after prolonged use. The latter results in a device which is short-lived, unreliable and noisy.

Additionally, vibrators of the prior art have not been sufficiently water-resistant. This frequently results in an apparatus which is used in an area that perspires, and can be contaminated with discharge and other bodily fluids but can not be submerged in soap and water for thorough cleaning. In extreme cases, the vibrator could not be used near water, such as a bathtub, shower, or hot tub, as may be present in some suggestive circumstances prescribed by the marital therapist.

OBJECTS AND SUMMARY OF INVENTION

It is therefore an object of this invention to provide a stimulator or marital aid for direct external stimulation for marital/sexual orgasmic therapy.

It is therefore a further object of this invention to provide a stimulator or marital aid which is gentle and adapted to apply stimulation over an appropriate area for marital/sexual orgasmic therapy.

It is therefore a further object of this invention to provide a stimulator or marital aid which departs from the traditional vibrating, even "hammering" motion or action.

It is therefore a still further object of this invention to provide a stimulator which rotationally oscillates through a suitably large angle for use in marital/sexual orgasmic therapy.

It is therefore a still further object of this invention to provide a stimulator which is light and easy to hold.

It is therefore a still further object of this invention to provide a stimulator which has a range of oscillatory angles and which has a variety of detachable applicators for use in marital/sexual therapy.

It is therefore a final object of this invention to provide a reliable, quiet stimulator for use in marital/sexual therapy which uses an alternating current power source from a wall socket while maintaining both a low temperature after prolonged use and sufficient water-resistance for submersion in soap and water and safety around water-related uses.

BRIEF DESCRIPTION OF THE DRAWINGS

FIG. 3 discloses a close-up view in perspective of the engagement between the handle and the attachment head of the present invention.

FIG. 4*a* discloses a close-up side view of the fixed multi-balls massager attachment of the present invention.

FIG. 4*b* discloses a front view of the fixed multi-balls massager attachment of the present invention.

FIG. 4*c* discloses a close-up view of the fixed multi-balls massager attachment as it rotates through an angle of operation of 20 degrees. This angle may be as low as 10 degrees in some embodiments.

FIG. 4*d* discloses a close-up view of the fixed multi-balls massager attachment as it rotates through an angle of operation of 40 degrees.

FIG. 4*e* discloses a close-up view of the fixed multi-balls massager attachment as it rotates through an angle of operation of 60 degrees. This angle may be as great as 80 degrees in some embodiments.

FIG. 5*a* discloses a close-up side view of the half ball with warts attachment of the present invention.

FIG. 5*b* discloses a front view of the half ball with warts attachment of the present invention.

FIG. 5*c* discloses a close-up view of the half ball with warts attachment as it rotates through an angle of operation of 20 degrees. This angle may be as low as 10 degrees in some embodiments.

FIG. 5*d* discloses a close-up view of the half ball with warts attachment as it rotates through an angle of operation of 40 degrees.

FIG. 5*e* discloses a close-up view of the half ball with warts attachment as it rotates through an angle of operation of 60 degrees. This angle may be as great as 80 degrees in some embodiments.

FIG. 6*a* discloses a close-up view of the flat-backed pod attachment of the present invention.

FIG. 6*b* discloses a close-up view of the flat-backed pod attachment as it rotates through an angle of operation of 60 degrees. This angle may be as great as 80 degrees in some embodiments.

DETAILED DESCRIPTION OF THE PREFERRED EMBODIMENT

Figure 1:
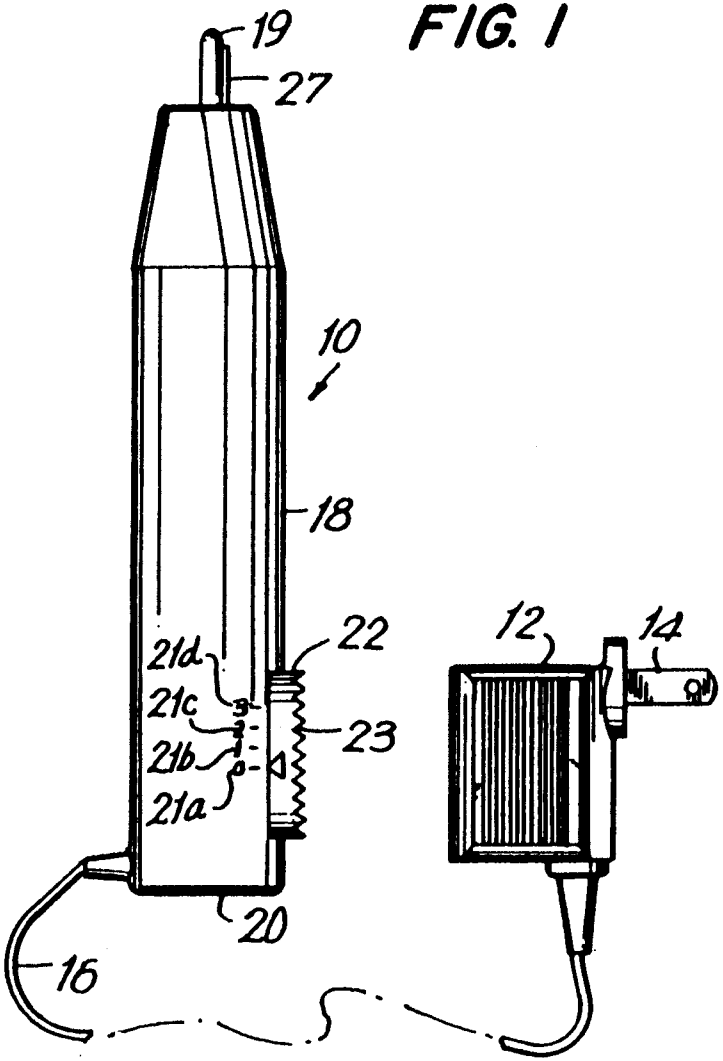
FIG. 1 discloses a front plan view of the present invention.

Referring to the drawings in detail wherein like numerals indicate like element throughout the several views, apparatus or marital aid 10 is disclosed in FIG. 1. Double insulated step-down transformer 12 receives standard 110/120 volt, 60 Hertz electricity from a wall socket through its prongs 14 and steps it down to 14 volts, 60 Hertz alternating current, using methods well-known to those skilled in the art. The 14 volts A.C. is transmitted through wire 16 to body 18.

Body 18 comprises a substantially unitary one-piece waterproof plastic shell. The combination of the reduced voltage from step-down transformer 12 along with the waterproof plastic shell allows apparatus 10 to be used safely around water. Furthermore, the use of a wall socket relieves the user from having to constantly supply fresh batteries during use.

Figure 2:
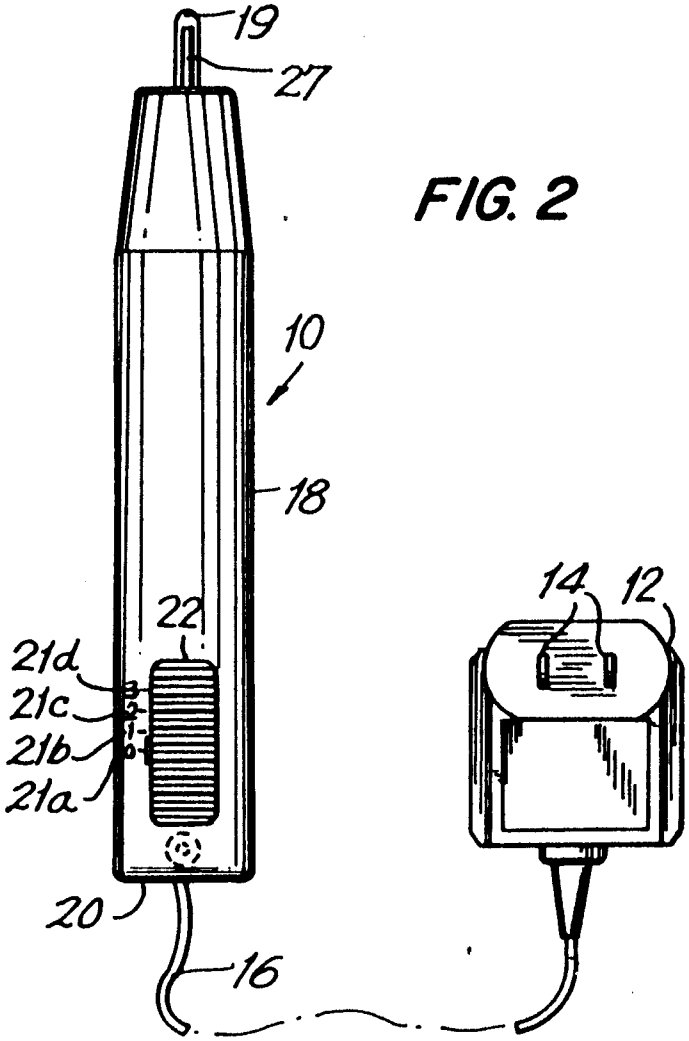
FIG. 2 discloses a side plan view thereof.

Body 18 includes a flat base 20 as disclosed in FIGS. 1 and 2 and a four-position switch 22 with a serrated thumb grip 23 which slides longitudinally along body 18 between successive detent positions 21*a*, 21*b*, 21*c* and 21*d*. Position 21*a* is the "Off" position. Position 21*b* is the position of switch 22 wherein stem 19 rotationally oscillates through an angle of operation substantially equal to twenty degrees at a frequency of 2000–8000 oscillations per minute, but preferably in the range of 3000–3600 oscillations per minute. Position 21*c* is the position of switch 22 wherein stem 19 rotationally oscillates through an angle of operation substantially equal to forty degrees at a frequency of 2000–8000 oscillations per minute, but preferably in the range of 3000–3600 oscillations per minute. Position 21*d* is the position of switch 22 wherein stem 19 rotationally oscillates through an angle of operation substantially equal to sixty degrees at a frequency 2000–8000 oscillations per minute, but preferably in the range of 3000–3600 oscillations per minute. While the preferred embodiment discloses an angle of operation ranging from 20–60 degrees, a range of 10–80 degrees is a suitable variation of the practice of this invention.

The mechanism contained within body 18 uses a motor such as is described in U.S. Pat. Nos. 4,595,849 and 4,595,850 which are incorporated herein by reference.

Stem 19 extends from the longitudinal axis of body 18 as shown in FIG. 3. Tab 27 extends from stem 19 so as to provide a rotational stop into which slot 24 of female attachment assembly 25 of the stimulator attachments 26 (fixed multi-balls massager), 28 (half ball with warts) and 30 (flat-backed pod) fit.

Additionally, female attachment assembly 25 includes semi-circular transverse detents 32 and 34 which mate onto transverse flanges 36 and 38 to provide a reliable yet releasable attachment between stem 19 and stimulator attachments 26,28,30.

Fixed multi-balls stimulator attachment 26 includes a conical frustrum-shaped base 40 extending from female attachment assembly 25 to hard-rubber disc-shaped pad 42 angled about sixty degrees from the longitudinal axis of base 40 as shown in FIG. 4*b*. Pad 42 includes several spherical stimulating protrusions 44 projecting therefrom.

Half-ball with warts stimulator attachment 28 includes a truncated conical base 46 with concave walls extending from female attachment assembly 25 to soft-rubber hemispherical head 36. Head 36 includes two vertically adjacent spherical stimulating protrusions 48 and two horizontally adjacent vertically aligned ellipsoid stimulating protrusions 50.

Flat-backed pod stimulator attachment 30 includes a truncated conical base 52 with concave walls extending from female attachment assembly 25 to soft-rubber pod-shaped head 54. Tabs 56 extend longitudinally along a portion of head 54.

To use apparatus 10, the user plugs step-down transformer 12 into a conventional wall socket and attaches the female attachment assembly 25 of any one of stimulator attachments 26, 28, 30. The user then chooses one of the three active positions of switch 22. The first active position 21*b* of switch 22 results in an angle of rotation of approximately 20 degrees of stimulator attachment 26, 28, 30 as shown in FIG. 4*c* and 5*c*. The second active position 21*c* of switch 22 results in an angle of rotation of approximately 40 degrees of stimulator attachments 26, 28, 30 as shown in FIGS. 4*d* and 5*d*. The third active position 21*d* of switch 22 results in an angle of rotation of 60 degrees of stimulator attachments 26, 28, 30 as shown in FIGS. 4*e*, 5*e* and 6*e*. While the preferred embodiment discloses an angle of operation ranging from 20–60 degrees, a range of 10–80 degrees is a suitable variation of the practice of this invention.

Regardless of the angle of rotation chosen, the stimulator attachment 26, 28, 30 is oscillated at 2000–8000 oscillations per minute, but preferably in the range of 3000 to 3600 oscillations per minute.

Stimulator attachment 26, 28, or 30 is then applied to patient as previously described.

Hence, the foregoing objectives are effectively attained.

Obviously, many modifications and variations of the invention are possible in light of the above description. It is therefore to be understood that within the scope of the appended claims, the invention may be practiced otherwise than as specifically described.

What is claimed is:

1. A stimulator for sexual therapy including:
means for inducing rotational oscillation through an angle of operation between ten degrees and eighty degrees at a frequency substantially within the range of 2000 to 8000 cycles per minute;
a brushless attachment adapted to external female stimulation free of substantial insertion; and
means for attaching said attachment to said inducing means.

2. A stimulator for sexual therapy including:
means for inducing rotational oscillation through an angle of operation between ten degrees and eighty degrees at a frequency substantially within the range of 2000 to 8000 cycles per minute;
an attachment adapted to external female stimulation including a base and a disc, wherein a longitudinal axis of said base and a longitudinal axis of said disc form an angle of substantially sixty degrees and wherein said disc includes several outwardly extending stimulating protrusions; and
means for attaching said attachment to said inducing means.

3. The stimulator of claim 2 wherein said disc and said protrusions are made of hard rubber.

4. A stimulator for sexual therapy including:
means for inducing rotational oscillation through an angle of operation between ten degrees and eighty degrees at a frequency substantially within the range of 2000 to 8000 cycles per minute;
an attachment adapted to external female stimulation including a base with an at least partially spherical head with several outwardly extending stimulating protrusions; and
means for attaching said attachment to said inducing means.

5. The stimulator of claim 4 wherein said head and said protrusions are made of soft rubber.

6. A stimulator for sexual therapy including:
means for inducing rotational oscillation through an angle of operation between ten degrees and eighty degrees at a frequency substantially within the range of 2000 to 8000 cycles per minute;
an attachment adapted to external female stimulation including a base with a substantially rectangular brushless pod-shaped head; and
means for attaching said attachment to said inducing means.

7. The stimulator of claim 6 wherein said head is made of soft rubber.

8. The stimulator of claim 1, 2, 4 or 6 wherein said angle of operation is in the range of twenty to sixty degrees and said frequency is in the range of 3000 to 3600 cycles per minute.

9. The stimulator of claim 8 wherein said rotational inducing means is responsive to a step-down transformer which is responsive to substantially 110 volt, 60 cycle per second, alternating current.

10. The stimulator of claim 9 wherein said step-down transformer supplies substantially 14 volt, 60 cycle per second, alternating current to said inducing means.

11. The stimulator of claim 10 wherein said rotational inducing means includes means for selectively adjusting said angle of operation.

12. The stimulator of claim 11 wherein said angle of operation is incrementally selectively adjustable throughout the range of substantially 20 to 60 degrees.

* * * * *